US012722831B2

(12) United States Patent
Barbolini

(10) Patent No.: US 12,722,831 B2
(45) Date of Patent: Sep. 1, 2026

(54) DEVICE FOR THE PACKAGING OF PRODUCTS, PARTICULARLY OF THE FOOD TYPE

(71) Applicant: Manicardi S.r.l., Fiorano Modenese (IT)

(72) Inventor: Alessandro Barbolini, Fiorano Modenese (IT)

(73) Assignee: MANICARDI S.R.L., Fiorano Modenese (IT)

( * ) Notice: Subject to any disclaimer, the term of this patent is extended or adjusted under 35 U.S.C. 154(b) by 0 days.

(21) Appl. No.: 18/868,560

(22) PCT Filed: May 12, 2023

(86) PCT No.: PCT/EP2023/062823
§ 371 (c)(1),
(2) Date: Nov. 22, 2024

(87) PCT Pub. No.: WO2023/227392
PCT Pub. Date: Nov. 30, 2023

(65) Prior Publication Data

US 2025/0346384 A1 Nov. 13, 2025

(30) Foreign Application Priority Data

May 26, 2022 (IT) ..... 102022000010997

(51) Int. Cl.
*B65B 1/18* (2006.01)
*B65B 25/02* (2006.01)
*B65B 57/04* (2006.01)

(52) U.S. Cl.
CPC ..... *B65B 57/04* (2013.01); *B65B 1/18* (2013.01); *B65B 25/02* (2013.01)

(58) Field of Classification Search
CPC .... B65D 81/2084; B65D 79/02; B65D 90/48; B65B 1/18; B65B 57/04; B65B 25/02; B65B 31/04
See application file for complete search history.

(56) References Cited

U.S. PATENT DOCUMENTS 7,788,968 B2 * 9/2010 Villers ..... G01M 3/3272 73/49.3
8,697,160 B2 * 4/2014 Becraft ..... B65D 75/38 426/125

(Continued)

FOREIGN PATENT DOCUMENTS

EP 2808268 A1 * 12/2014 ..... G01N 1/2226
EP 3604168 A1 2/2020

(Continued)

OTHER PUBLICATIONS

International Search Report issued on Aug. 3, 2023, in International Application No. PCT/EP2023/062823.

(Continued)

*Primary Examiner* — Andrew M Tecco
(74) *Attorney, Agent, or Firm* — Panitch Schwarze Belisario & Nadel LLP

(57) ABSTRACT

A device for the packaging of products, particularly of the food type, includes a container made of material that is flexible and substantially impermeable to gases and water vapor. The container forms inside it a compartment for accommodating products and is provided with at least one passage opening for the introduction and/or evacuation of the products into/from the compartment. At least one functional port can be closed hermetically and is associated with the container in fluid communication with the accommodation compartment. At least one monitoring port is associated with the container in fluid communication with the accommodation compartment, which is adapted to allow the pas- (Continued)

sage of fluid at least from the inside of the compartment toward the outside. An assembly for detecting at least one chemical-physical parameter of the atmosphere is located within the accommodation compartment.

4 Claims, 9 Drawing Sheets

(56) References Cited

U.S. PATENT DOCUMENTS

| | | | | |
|---|---|---|---|---|
| 9,090,392 | B2 * | 7/2015 | Loeschen | B65D 90/046 |
| 11,814,240 | B2 * | 11/2023 | Aguilar Monforte | F16K 27/0209 |
| 2008/0202213 | A1 * | 8/2008 | Villers | G01M 3/3272 73/49.3 |
| 2020/0024067 | A1 * | 1/2020 | Aguilar Monforte | B65D 88/1668 |
| 2020/0315098 | A1 * | 10/2020 | Poujaud | A01F 25/14 |

FOREIGN PATENT DOCUMENTS

| | | | |
|---|---|---|---|
| EP | 3472067 | B1 | 3/2021 |
| WO | 2022050843 | A1 | 3/2022 |

OTHER PUBLICATIONS

Written Opinion issued on Aug. 3, 2023, in International Application No. PCT/EP2023/062823.
Search Report and Written Opinion issued on Jan. 13, 2023, in IT Application No. 202200010997, with English translation of the Written Opinion.

* cited by examiner

DEVICE FOR THE PACKAGING OF PRODUCTS, PARTICULARLY OF THE FOOD TYPE

CROSS-REFERENCE TO RELATED APPLICATIONS

This application is a Section 371 of International Application No PCT/EP2023/062823, filed May 12, 2023, which was published in the English language on Nov. 30, 2023, under International Publication No. WO 2023/227392 A1, which claims priority under 35 U.S.C. § 119 (b) to Italian Application No. 102022000010997, filed May 26, 2022, the disclosures of each of which are incorporated herein by reference in their entireties.

The present invention relates to a device for the packaging of products, particularly of the food type.

With particular but not exclusive reference to the agricultural sector, packaging devices are known which allow the preservation, storage and possibly transportation of products such as cereals, seeds and grains in an inert environment, in order to protect them from deterioration caused by the attack of parasites, by the proliferation of molds and bacteria and by oxidative processes.

As is known, the preservation of agroalimentary products is aimed at preserving their characteristics (e.g., edibility and nutritional value) over time, avoiding the proliferation of bacteria, fungi, molds and other microorganisms that would tend to produce waste substances that are toxic to humans and limiting oxidative processes.

In some cases, these devices consist of hermetically sealed containers inside which the products can be kept in vacuum conditions, i.e., at a pressure below atmospheric pressure.

One solution of this type, for example, is known from EP 3472067 B1, which describes a vacuum storage and transport device comprising a gas-tight container and provided with a filling port, which is hermetically sealed after introducing the products, and a one-way valve that only allows the passage of gas from the inside of the container outward. Said device comprises, moreover, a transport bag provided with handling slots inside which the filled and sealed container is inserted.

After inserting the products into the container and sealing its filling port, air is extracted from inside said container through the one-way valve by means of an extraction unit so that the products remain in an inert environment under vacuum.

This anaerobic preservation technique is based on the principle that the respiration of the microflora that is present inside the container rapidly consumes the residual oxygen and releases carbon dioxide, which fills the interstitial spaces between the products, inhibiting their degradation.

Such device can be equipped with sensors to detect or measure information about the atmosphere that is present inside the containers, such as for example sensors for humidity, temperature, or carbon dioxide concentration.

This device of a known type, however, is not free from drawbacks, which include the fact that the time required for depletion of the residual oxygen inside the container cannot be predicted in advance, and the risk therefore remains that product degradation processes might be triggered in the meantime, in addition to the fact that any parasite eggs could hatch even after the death of the parasites that generated them, thus initiating further product attacks.

To obviate these drawbacks, preservation systems are known which involve introducing the products inside hermetically sealed containers, made of a material having reduced permeability to gases and water vapor, from the inside of which the residual air is extracted and into which inert gas, such as nitrogen or carbon dioxide, is introduced. The amount of inert gas to be introduced is generally controlled by measuring its weight or dispensing time, depending on the size of the container, the type of products placed inside it, and the expected storage time. Such systems generally provide for monitoring of chemical and physical parameters of the atmosphere inside the container during storage.

For example, electronic devices for measuring these parameters are known which are equipped with a needle probe that must be introduced through the wall of the container to perform the necessary checks. The assigned operators must therefore periodically perform these measurements on all the units in store, taking care to then seal the probe insertion holes in order to restore the seal of the containers.

This mode of operation entails the need to employ a lot of labor to carry out the checks, in addition to the risk of compromising the seal of the containers and therefore compromising the state of preservation of the products inside them.

Likewise, US 2008/0202213 A1 describes an alternative solution in which a hermetically sealed container is used which is provided with a one-way sampling valve in order to perform periodic sampling of the gas mixture inside the container by means of a hand pump and measurement of the relative oxygen concentration with the aid of an appropriate sensor. In an alternative embodiment, the container is associated with an electronic device for measuring and recording data related to oxygen and carbon dioxide concentration, temperature and humidity of the internal air, which is accommodated within the container and can communicate these data to an external receiver via a connecting cable or via remote connection devices.

In the first case, drawing air through the sampling valve requires the manual intervention of an assigned operator. In the second case, the need to accommodate the electronic device inside the container to perform the required measurements does not make it possible to verify its proper operation and complicates the operations to be carried out if replacement or maintenance work is required.

The aim of the present invention is to eliminate the drawbacks of the background art cited above by providing a device for the packaging of products, particularly of the food type, that makes it possible to perform automatically the checks that are necessary to ensure the quality of the products, reducing, if not eliminating, the use of labor.

Within this aim, an object of the present invention is to allow optimal disinfestation from parasites that can damage the quality of the packaged products, avoiding the formation of waste products with consequent economic damage.

Another object of the present invention is to allow timely and effective monitoring of the state of preservation of the products, as well as of the proper functioning of the electronic devices used, facilitating their maintenance or replacement if necessary.

A further object of the present invention is to have a constructive form that is simple and with a reduced number of components.

Another object of the present invention is to be able to reuse the electronic components with different containers, so as to contain purchase costs for users.

Not the least object of the present invention is to have a structure that is simple, relatively easy to provide in practice, safe in use, effective in operation, and relatively low-cost.

This aim and these and other objects that will become more apparent hereinafter are all achieved by the present device for the packaging of products, particularly of the food type, according to claim 1 and optionally provided with one or more of the characteristics set forth in the dependent claims.

Further characteristics and advantages of the present invention will become more apparent from the detailed description of some preferred but not exclusive embodiments of a device for the packaging of products, particularly of the food type, illustrated by way of non-limiting example in the accompanying drawings, wherein.

Figure 1:
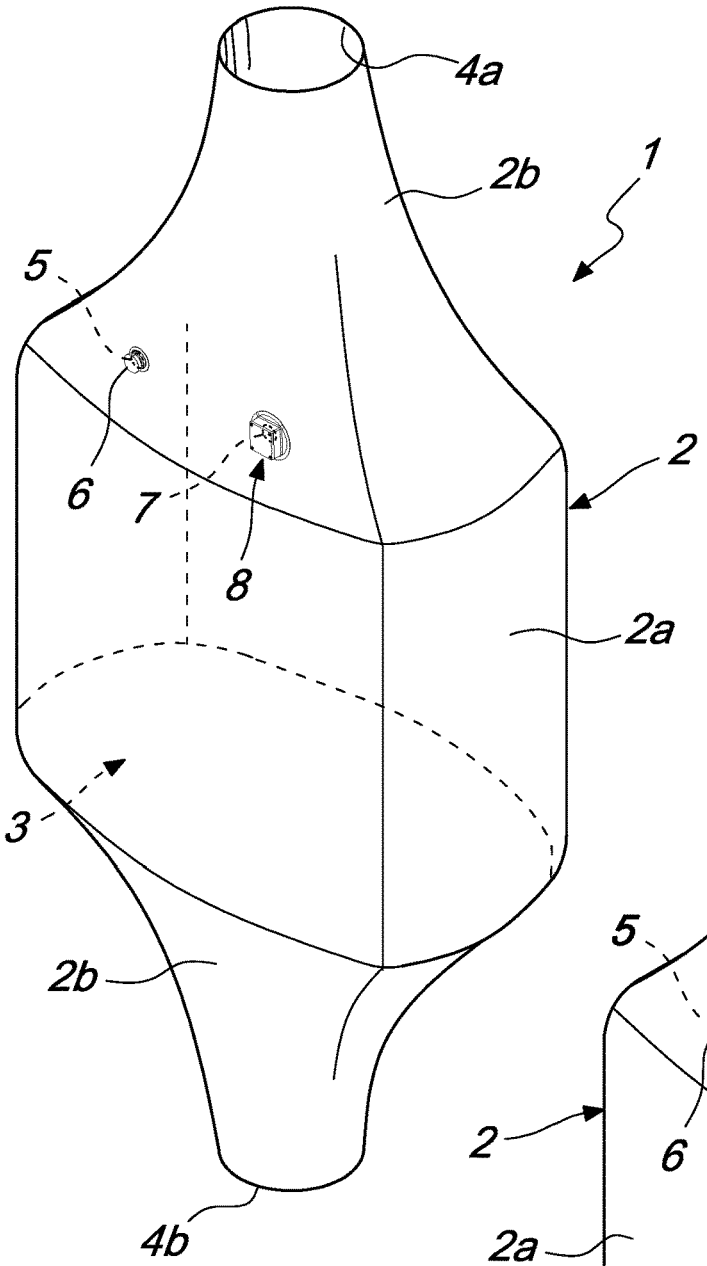
FIG. 1 is a perspective view of a first embodiment of a device for the packaging of products, particularly of the food type, according to the invention.

With particular reference to the figures, a device for the packaging of products, particularly of the food type, is generally designated by the reference numeral 1.

The device 1 can be used, for example, to package bulk and non-bulk products, such as cereals, grains, and the like, for the purpose of preservation and/or transportation.

Figure 2:
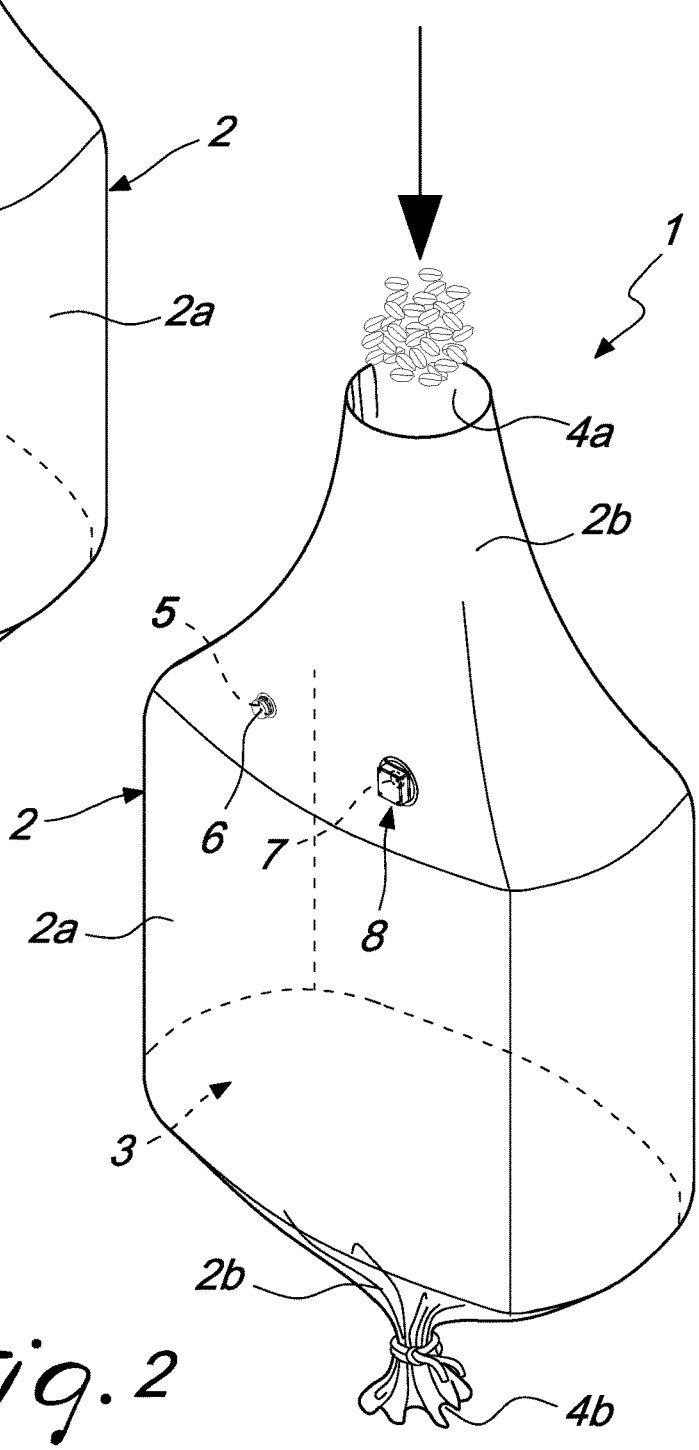
FIGS. 2-6 are perspective views of successive operational steps of a product packaging method that uses the device of FIG. 1.
Figure 3:
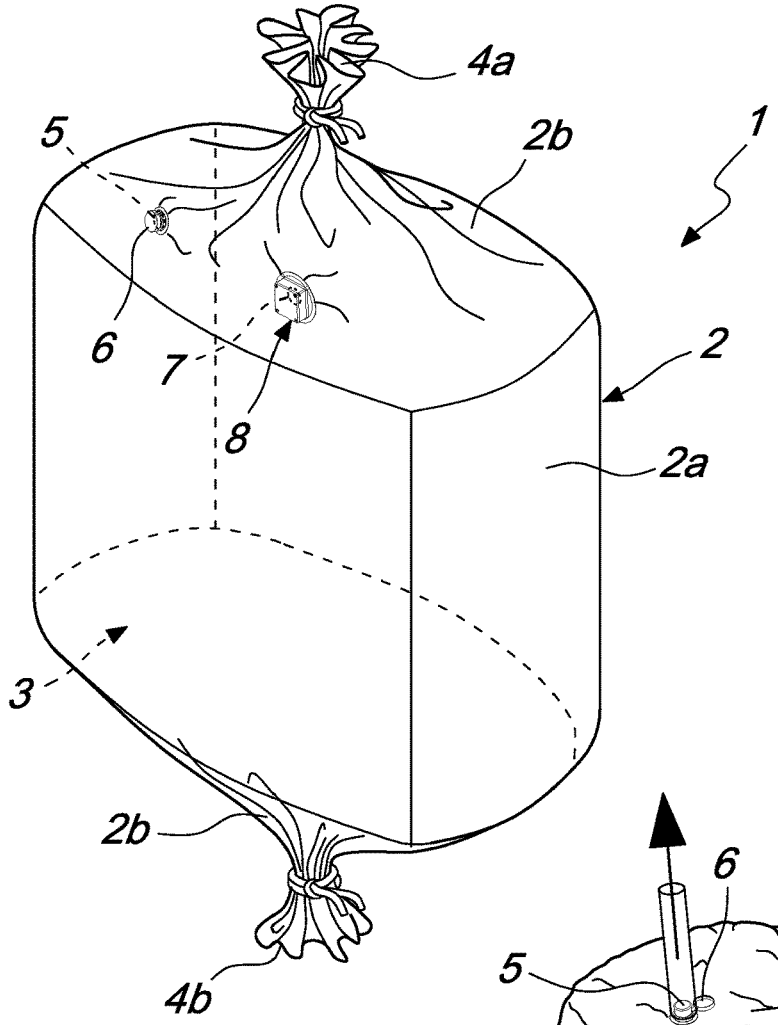
Figure 4:
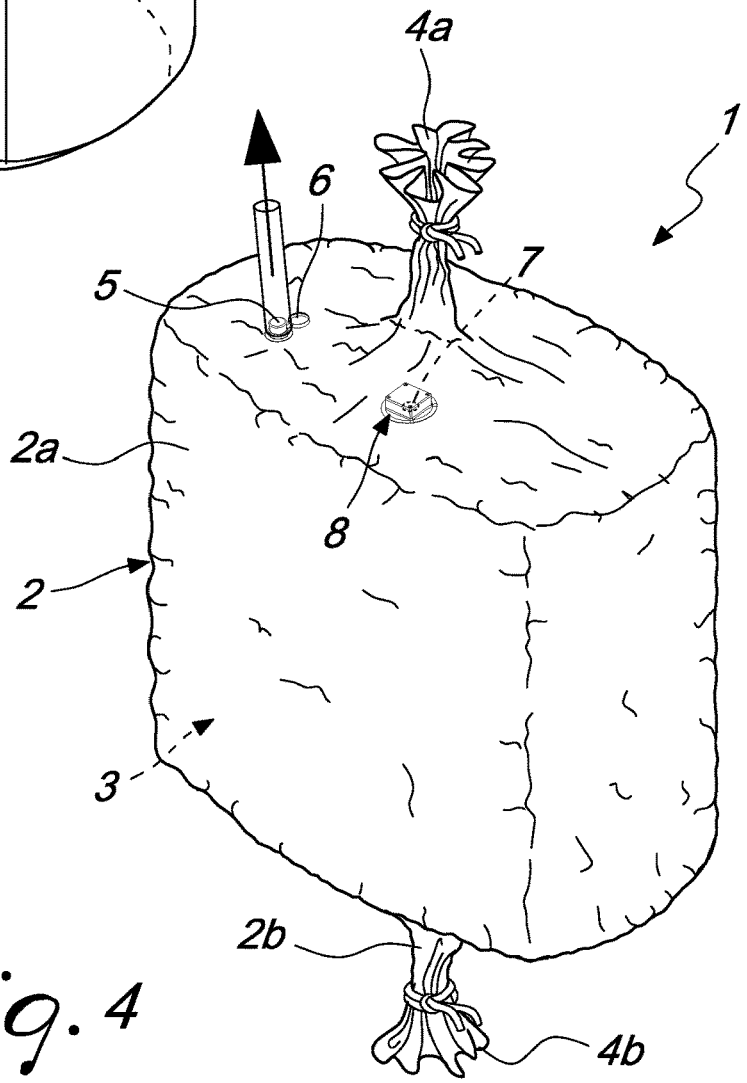
Figure 5:
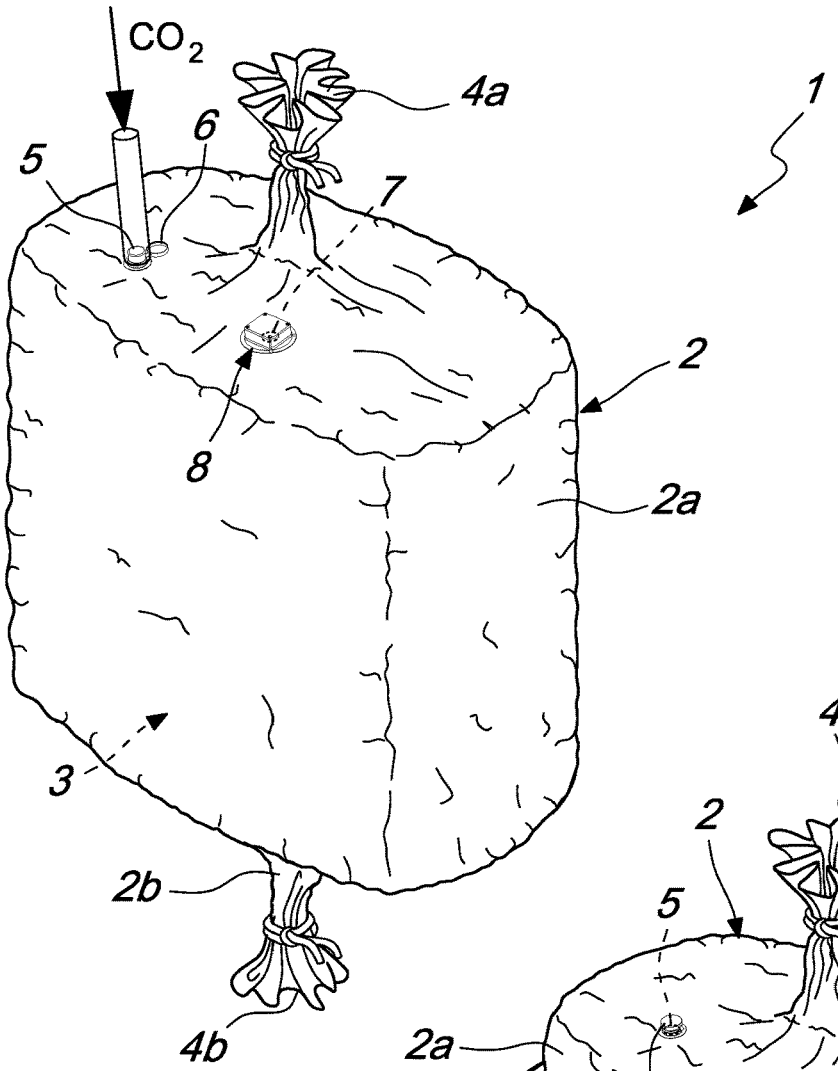

In FIG. 2, the products P are shown by way of example as bulk grains, but the possibility of using the device 1 for other uses, even outside the food sector, is not ruled out.

The device 1 comprises a container 2 made of material that is flexible and substantially impermeable to gases and water vapor (moisture), which forms inside it a compartment 3 for accommodating the products and is provided with at least one passage opening 4 for the introduction and/or evacuation of the products into/from said compartment.

The term "substantially" is understood to mean "within usual manufacturing tolerances".

The container 2 is made of a material that makes it possible to obtain a bidirectional barrier effect to the passage of gas and water vapor (moisture). In greater detail, said material preferably has an oxygen transmission rate (OTR) at most equal to 6 $cm^3/m^2/24$ h and a water vapor transmission rate (WVTR) at most equal to 20 $g/m^2/24$ h.

The container 2 can be made, for example, of multilayer materials obtained by co-extrusion of different layers of plastic material (polyamide PA, ethylene vinyl alcohol EVOH, polyethylene PE) or of thin plastics coated with sealing materials or with bonded layers of aluminum with polypropylene PP or polyethylene PE or polyamide PA or other thermoplastic material.

The shape and dimensions of the container 2 may vary depending on the intended use of the device 1.

The at least one passage opening 4, in use, must be sealed hermetically and may be provided with adapted pressure- or hinge-type hermetic closure elements.

Figure 15:
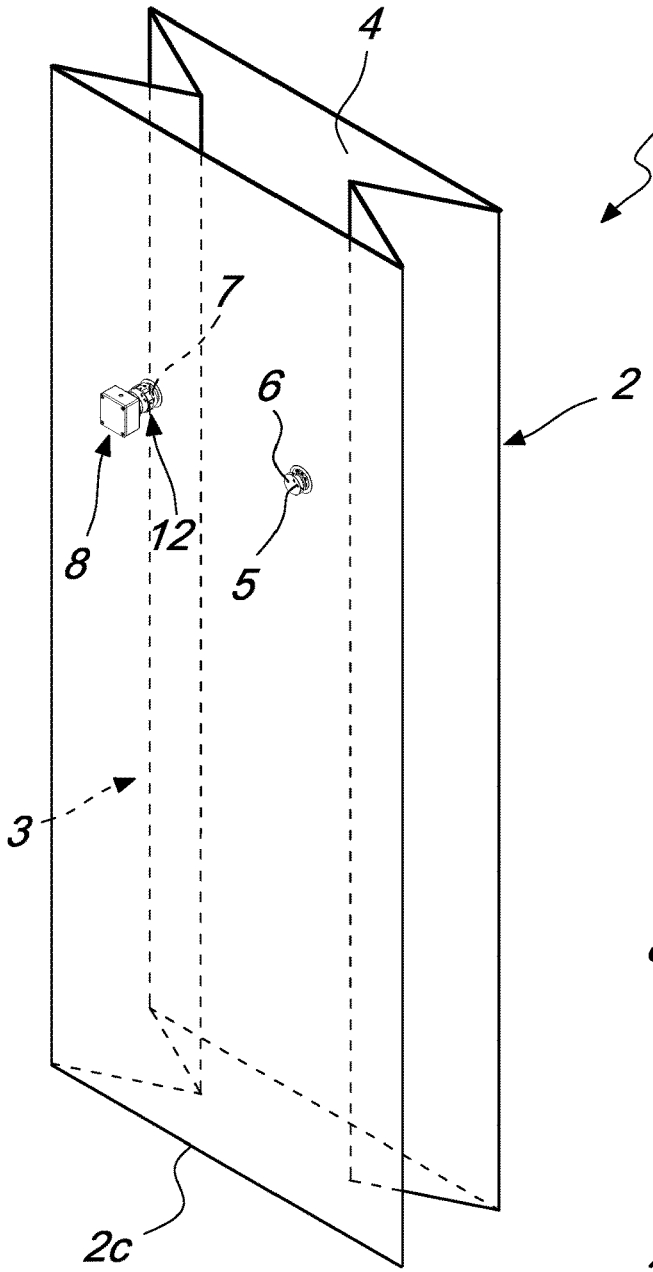
FIG. 15 is a perspective view of a third embodiment of the device according to the invention.
Figure 16:
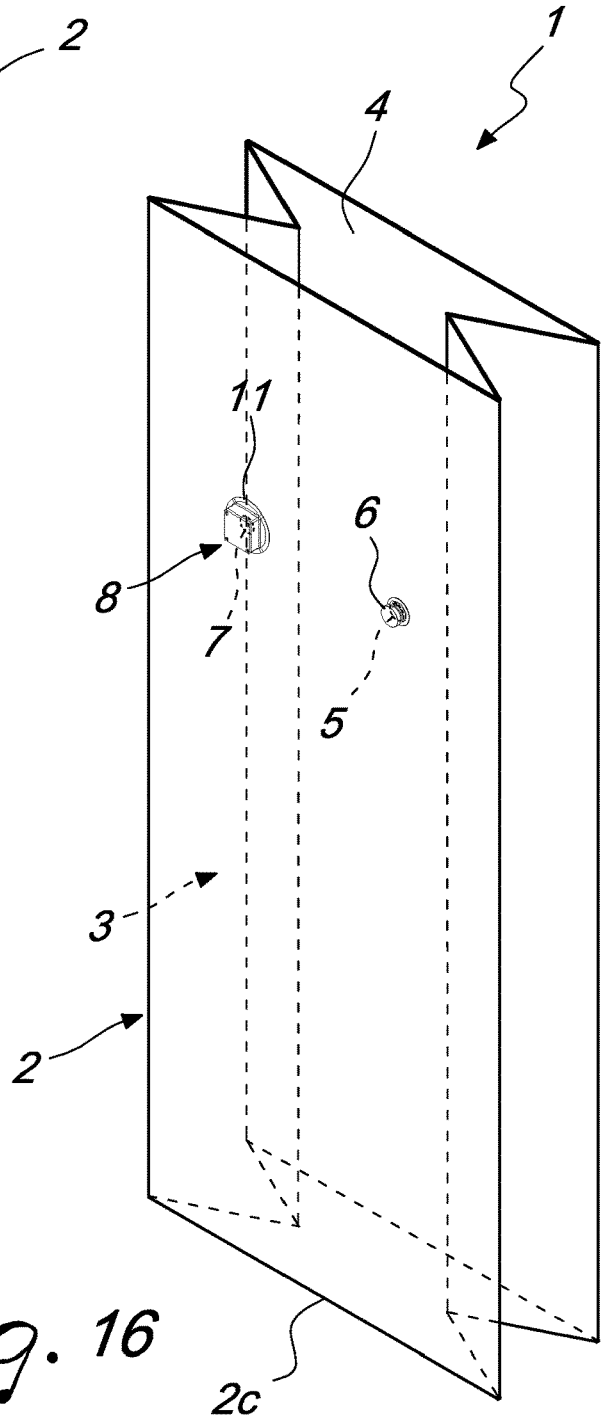
FIG. 16 is a perspective view of a fourth embodiment of the device according to the invention.
Figure 17:
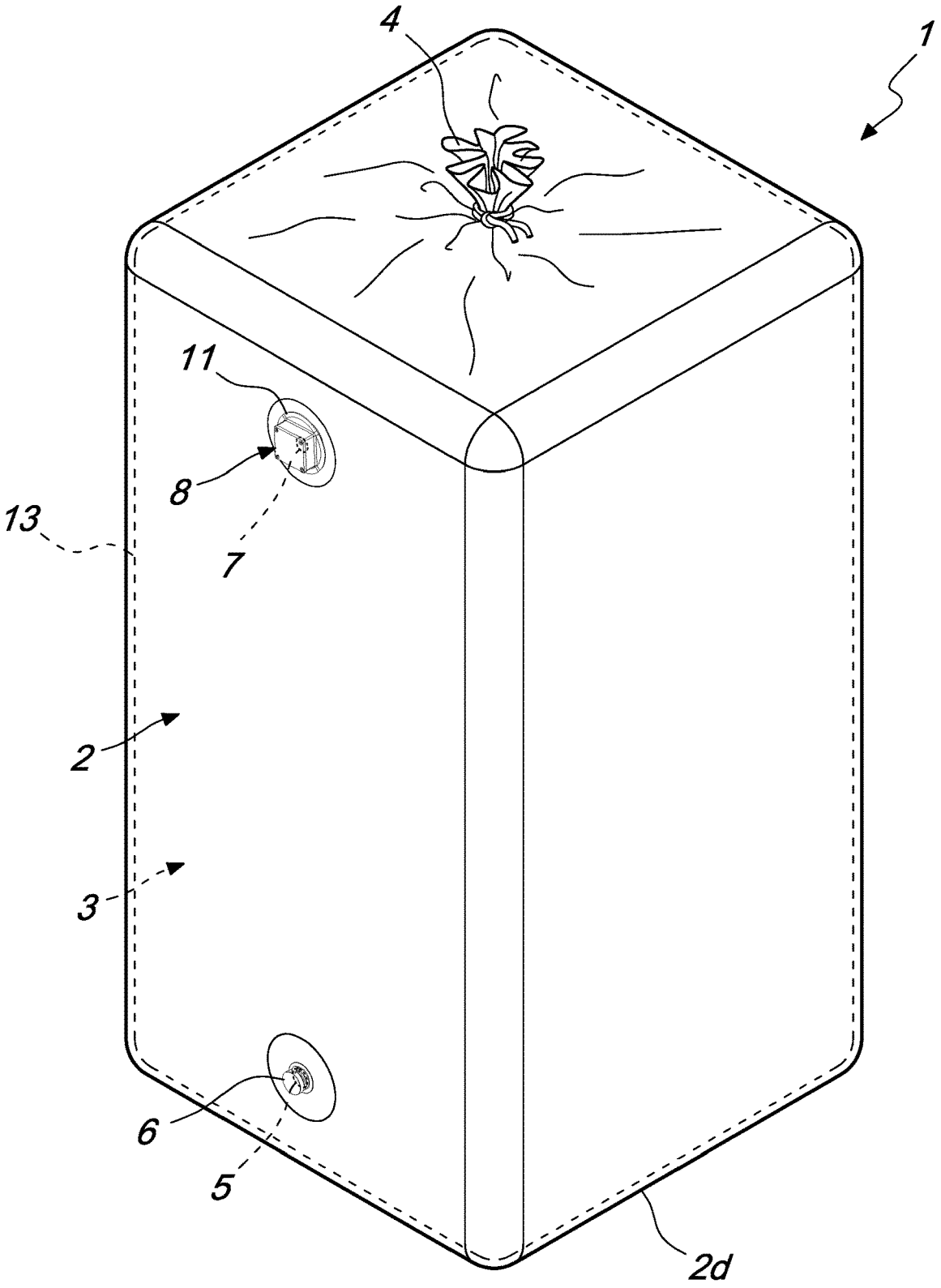
FIG. 17 is a perspective view of a fifth embodiment of the device according to the invention.

In one possible embodiment, the container 2 is provided with a single passage opening 4 for the introduction and evacuation of the products into/from the accommodation compartment 3 (FIGS. 15-17).

Alternatively, the container 2 can be provided with two passage openings 4*a* and 4*b*, a first opening 4*a* for the introduction of the products in the accommodation compartment 3 and a second opening 4*b* for the evacuation of the products from said accommodation compartment 3 (FIGS. 1-14). Generally, the first opening 4*a* is provided in the upper part of the container 2 (with reference to positioning in conditions for use) and the second opening 4*b* is provided in the lower part of said container.

The shape, size and positioning of the passage opening(s) 4 or 4*a* and 4*b* may vary depending on the intended use of the device 1.

The device 1 furthermore comprises at least one functional port 5 associated with the container 2 in fluid communication with the accommodation compartment 3. Said functional port 5 can be closed hermetically when not in use.

The at least one functional port 5 is preferably formed by a through opening provided directly in a wall of the container 2, but alternative embodiments are not excluded.

The device 1 may have first valve means, normally in a closed configuration and adapted to allow the passage of fluid in at least one direction when actuated in the open configuration, associated with the at least one functional port 5. Such first valve means are not shown in detail since they are of a conventional type.

The first valve means in the open configuration may be adapted to allow bidirectional flow of fluid from the inside of the accommodation compartment 3 outward and vice versa.

Moreover, a removable closure 6 may be provided to close and protect the functional port 5 when not in use. If the first valve means are not provided, the closure 6 must close hermetically the functional port 5 when not in use.

The device 1 preferably comprises a single functional port 5, but it is not excluded that two functional ports 5 might be provided.

In the latter case, the first valve means possibly associated with each functional port 5 may allow, in the open configuration, a bidirectional or unidirectional flow (one toward the inside and one toward the outside of the accommodation compartment 3).

The device 1 further comprises at least one monitoring port 7 associated with the container 2 in fluid communication with the accommodation compartment 3, which is adapted to allow the passage of fluid at least from the inside toward the outside of said compartment.

The at least one monitoring port 7 is preferably formed by a through opening provided directly in a wall of the container 2, but alternative embodiments are not excluded.

The device 1 provides for an assembly 8 for the detection of at least one chemical-physical parameter of the atmosphere inside the accommodation compartment 3.

In greater detail, the detection assembly 8 comprises a measurement chamber 9 associated in fluid communication with the accommodation compartment 3 through the monitoring port 7 and at least one sensor 10 for measuring the at least one parameter functionally associated with the measurement chamber 9.

Preferably, the detection assembly 8 is arranged outside the accommodation compartment 3.

Even more preferably, the detection assembly 8 is arranged at least partially outside the container 2.

In the embodiments shown, the detection assembly 8 is arranged completely outside the container 2.

The measurement chamber 9 of the detection assembly 8 is arranged in fluid communication with the inside of the accommodation compartment 3 through the monitoring port 7. In this way, the atmosphere that is present inside the accommodation compartment 3 is equalized with the one that is present in the measurement chamber 9 at which the measurement is made.

Preferably, the at least one sensor 10 directly faces the inside of the measurement chamber 9, so as to test the atmosphere that is present in the chamber and arrives from the accommodation compartment 3.

The at least one sensor 10 may be chosen from the group comprising a sensor for measuring the concentration of an inert gas, a sensor for measuring the concentration of oxygen, a pressure sensor, a humidity sensor, or a temperature sensor.

The inert gas concentration measurement sensor may preferably be a carbon dioxide concentration measurement sensor. The carbon dioxide concentration measurement sensor can be capable of detecting any level of concentration (0-100%).

Moreover, the pressure sensor can be an absolute or relative pressure measurement sensor.

The detection assembly 8 may comprise two or more sensors 10, preferably chosen from the group listed above.

Moreover, the detection assembly 8 comprises an electronic unit for the collection and processing of data which is functionally associated with the at least one sensor 10, of the type of a conventional programmed or programmable electronic board (not shown in the figures). Said electronic data collection and processing unit receives in input the values detected by the at least one sensor 10.

The detection assembly 8 also comprises a conventional remote data transmission device functionally associated with said data collection and processing unit, which operates according to a known data transfer technology and is not shown.

Such detection assembly 8 may be associated hermetically with the monitoring port 7 in a permanent manner.

In this case, the outer body of the detection assembly 8 may have a flange 11, or the like, which is heat-sealed or bonded to the outer wall of the container 2 proximate to the monitoring port 7.

The monitoring port 7 can be provided by a free opening that allows two-way fluid communication between the inside of the accommodation compartment 3 and the measurement chamber 9.

Moreover, the detection assembly 8 can be associated temporarily and hermetically with the monitoring port 7. In this way, a single detection assembly 8 can be applied alternately to a plurality of containers 2 and/or be reused in case of damage and replacement of the container 2 in use. This particular arrangement makes it possible to reduce the investments required for adoption of the invention in use.

Preferably, connection means 12 are interposed between the monitoring port 7 and the detection assembly 8 and comprise a first element 12*a* associated with the detection assembly 8 and a second element 12*b* associated with the monitoring port 7, which can be mutually coupled/uncoupled for example by means of a quick-connect (snap, bayonet or the like) or threaded coupling, said elements not being shown in detail since they are of a known type.

The connection means 12 are crossed by a connecting channel 16 between the monitoring port 7 and the measurement chamber 9.

The monitoring port 7 can be provided by a free opening which allows two-way fluid communication between the inside of the accommodation compartment 3 and the measurement chamber 9. As an alternative, second valve means associated with the monitoring port 7 may be provided which are normally in the closed configuration and are adapted to allow at least the passage of fluid from the inside of the accommodation compartment 3 toward the measurement chamber 9 when actuated in the open configuration. Said second valve means are not shown in detail since they are of a conventional type.

If the connection means 12 and the second valve means are provided, the latter are actuated in the open configuration by coupling the first element 12*a* with the second element 12*b*, the uncoupling of the first element 12*a* activating the return of the second valve means to the closed configuration.

Moreover, a removable closure 15 can be provided to close and protect the monitoring port 7 when it is not coupled to the detection assembly 8. If the second valve means are not provided, the closure 15 must close the monitoring port 7 hermetically when it is not in use.

Moreover, the device 1 may have at least one product containment element 13 positioned inside the accommodation compartment 3 (FIG. 17). The containment element 13 must be made of a material that is substantially permeable to gases and water vapor (moisture), so that the atmosphere inside said element permeates inside the accommodation compartment 3. Moreover, since it is in direct contact with the products, the containment element 13 must be made of a material with appropriate hygienic and compatibility requirements where required.

Multiple product units may be placed in the accommodation compartment 3, each enclosed in a respective containment element 13.

Figure 6:
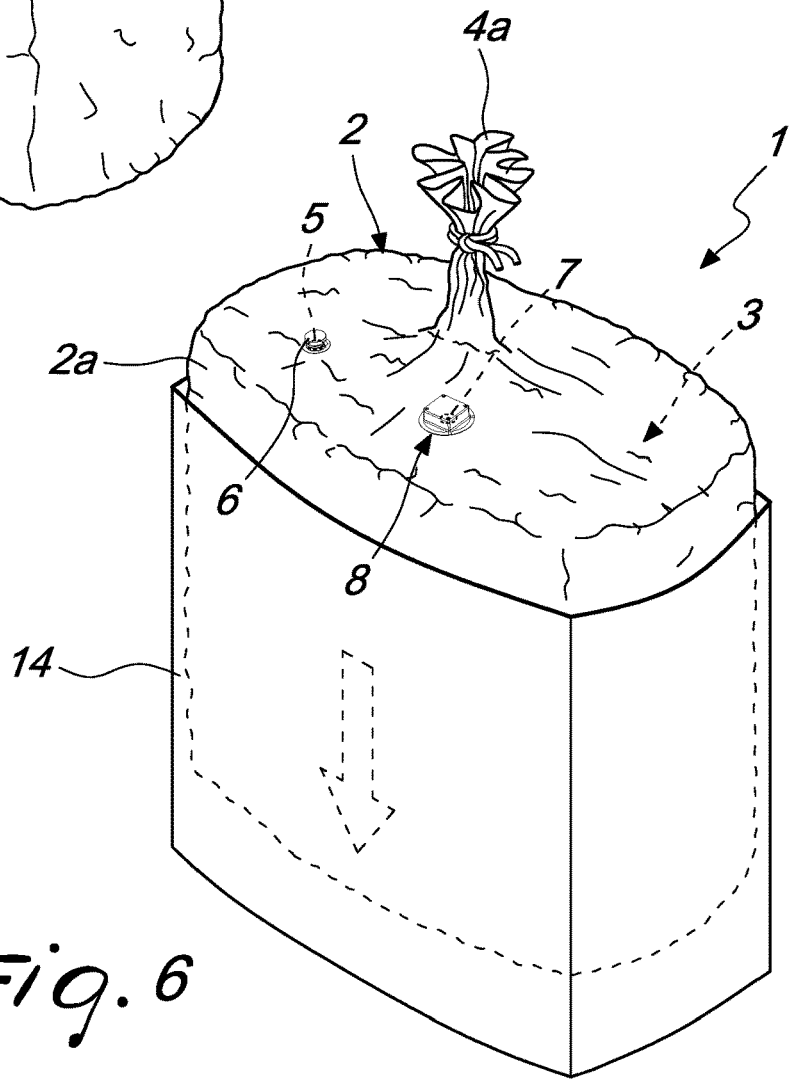
Figure 7:
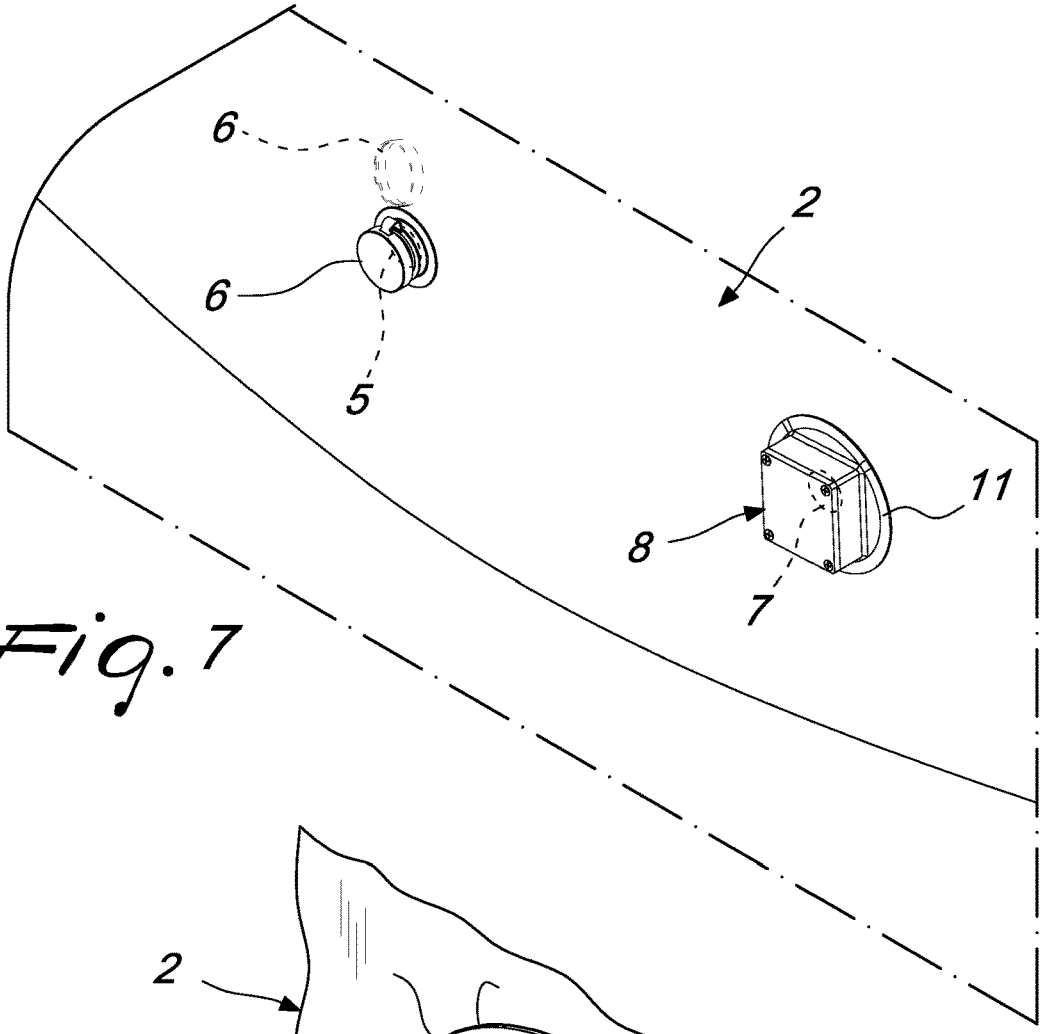
FIG. 7 is an enlarged-scale view of a portion of the device of FIG. 1.
Figure 8:
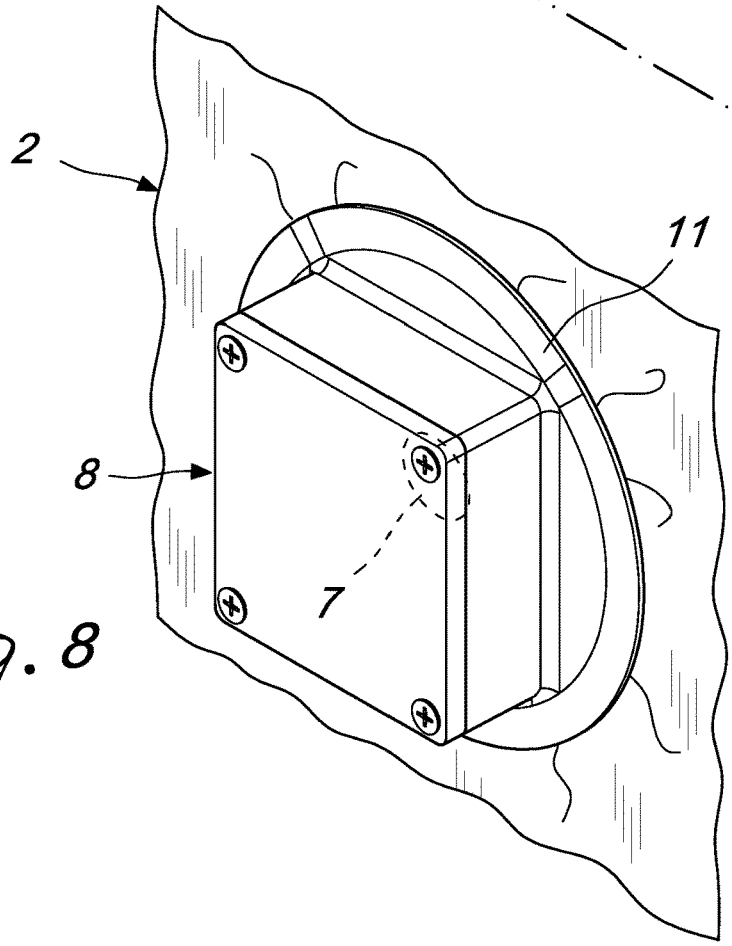
FIG. 8 is an enlarged-scale perspective view of the detection assembly of FIG. 7.
Figure 9:
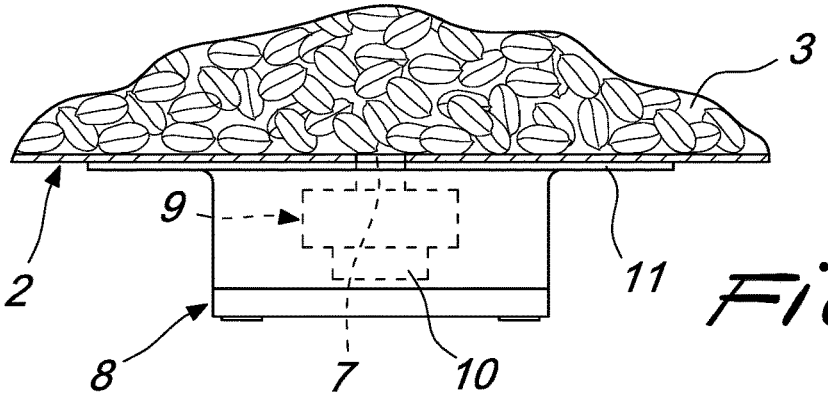
FIG. 9 is a partially sectional view of FIG. 8.
Figure 10:
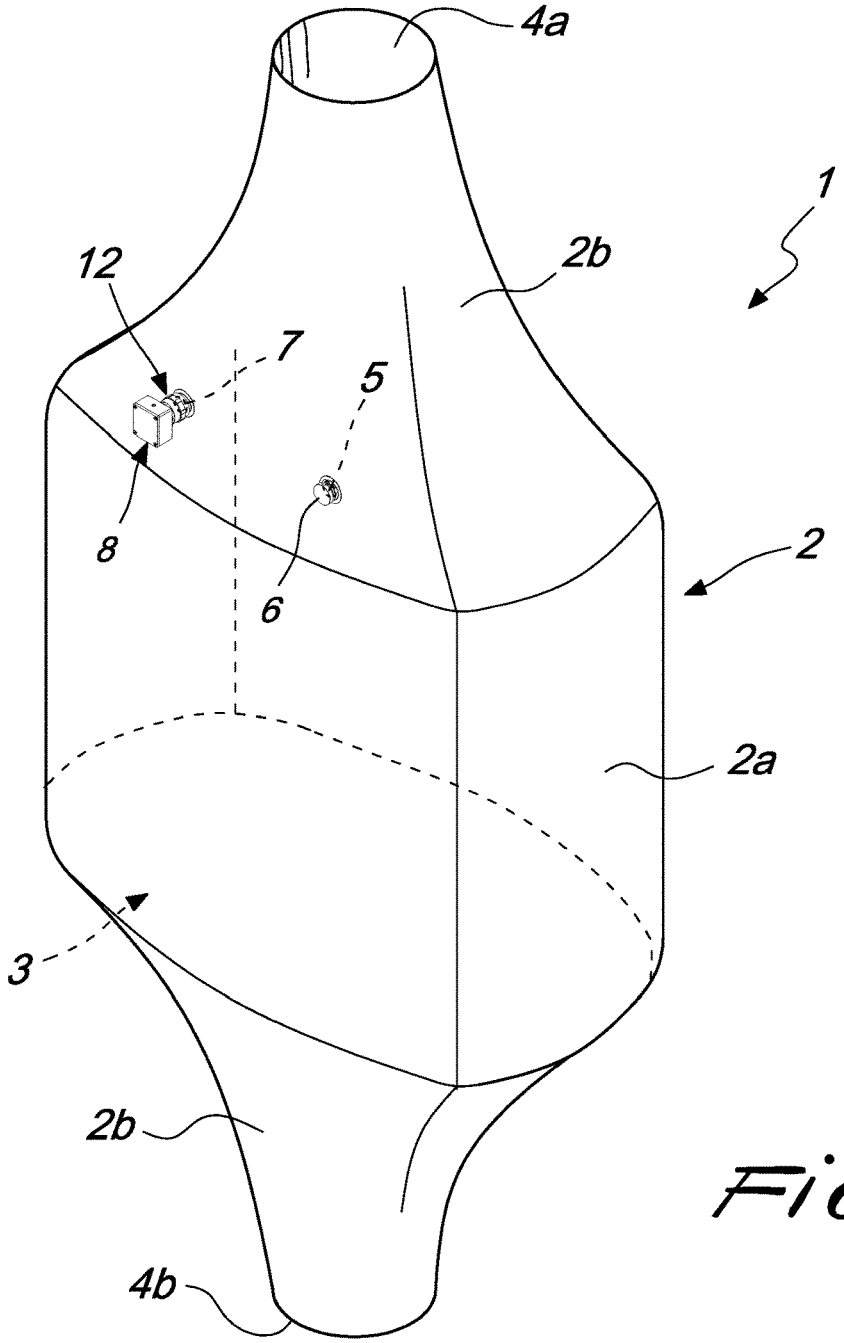
FIG. 10 is an perspective view of a second embodiment of the device according to the invention.
Figure 11:
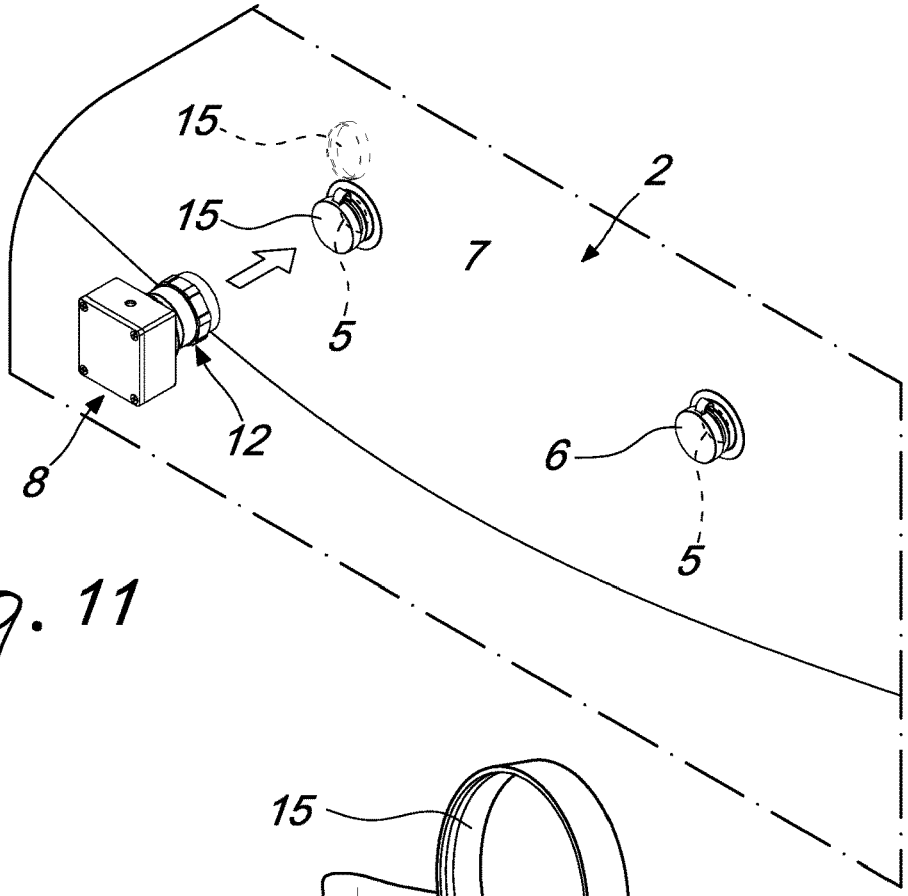
FIG. 11 is an enlarged-scale view of a portion of the device of FIG. 10, in the step of application of the detection assembly to the monitoring port.
Figure 12:
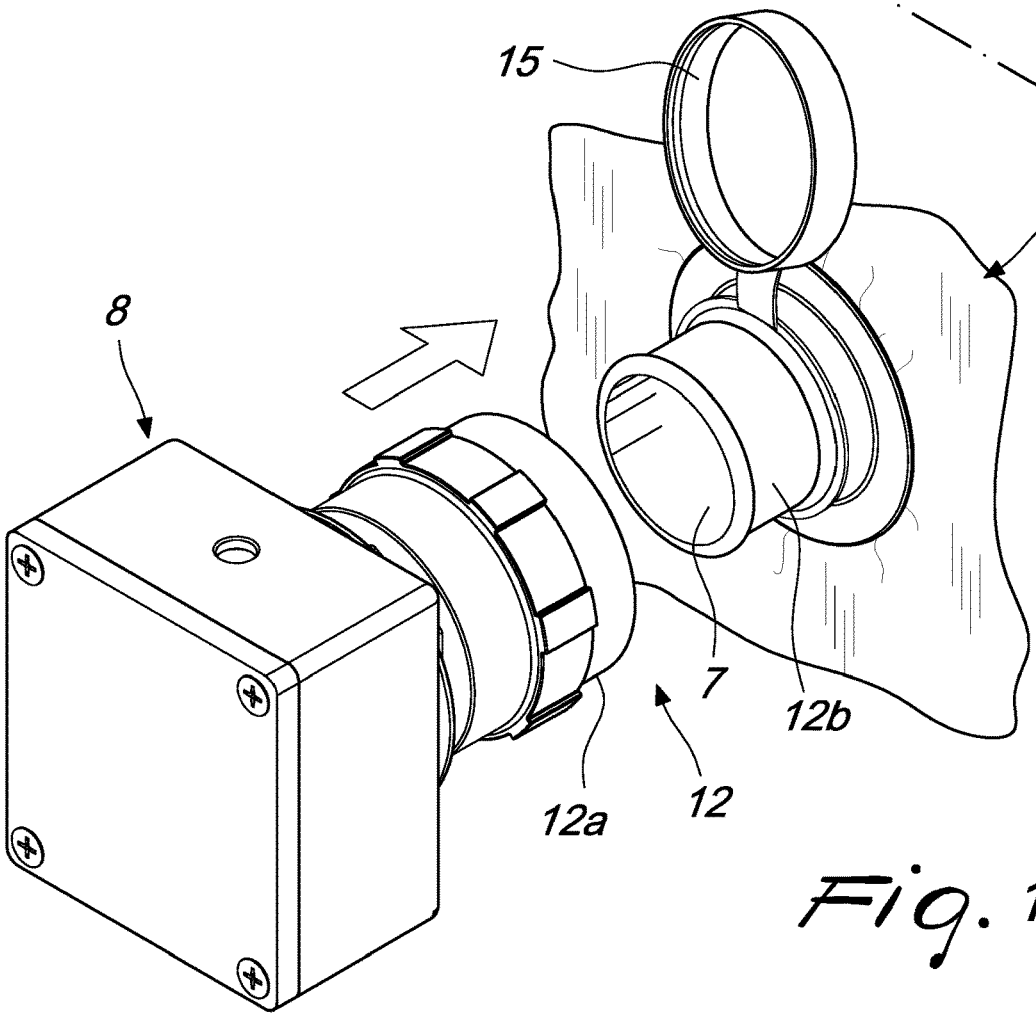
FIGS. 12 and 13 are perspective views of the detection assembly of the device of FIG. 10 during the step of application to the monitoring port and applied to said port, respectively.
Figure 13:
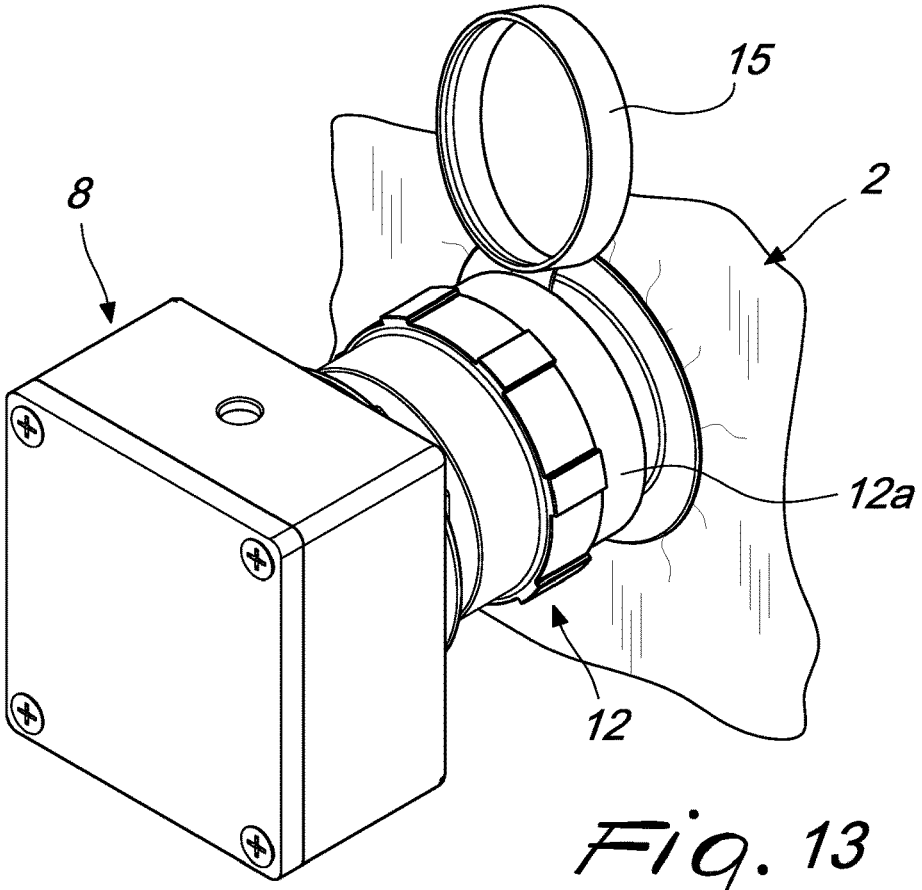
Figure 14:
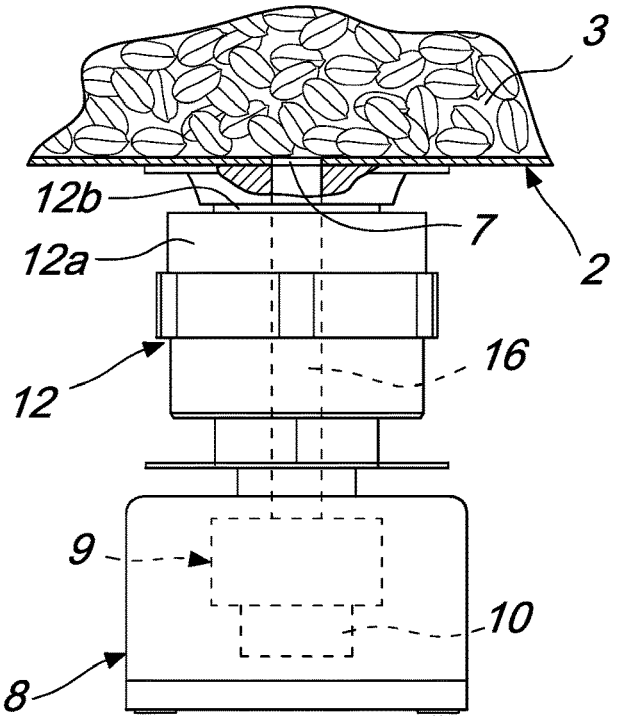
FIG. 14 is a partially sectional view of FIG. 13.

Finally, the device 1 may provide for a protection and/or transport element 14 inside which the container 2 is placed (FIG. 6). The element 14 may be provided with grip elements, not shown, to facilitate the transport of device 1.

FIGS. 1-9 show a first embodiment of the device 1 in which the container 2 is provided with a first opening 4*a* for product insertion and with a second opening 4*b* for product exit, with a functional port 5 associated with a removable closure 6, and with a monitoring port 7 permanently associated with a detection assembly 8.

The container 2 has a central tubular portion 2*a* that forms the lateral walls of the accommodation compartment 3 and is connected on opposite sides to respective funnel-shaped portions 2*b* which form at their ends the openings 4*a* and 4*b*, which in use, once sealed, constitute the bottom and top of said compartment.

It should be noted that when the openings 4*a* and 4*b* are sealed, the functional port 5 is closed hermetically and the monitoring port 7 is associated hermetically with the detection assembly 8 and the accommodation compartment 3 inside the container is substantially isolated from the external environment.

This embodiment of the device 1 is particularly designed to be used to package bulk products arranged inside the accommodation compartment 3 directly in contact with the internal walls of the container 2.

Moreover, an external element 14 for the containment of the container 2 can be provided.

FIGS. 10-14 show a second embodiment of the device 1 which comprises a container 2 of the type described above, provided with a first opening 4*a* for product insertion and with a second opening 4*b* for product exit, with a functional port 5 associated with a removable closure 6, and with a monitoring port 7 temporarily associated with a detection assembly 8.

Connection means 12 are provided between the monitoring port 7 and the detection assembly 8.

An external element 14 for the containment of the container 2 can be provided in this case also.

FIG. 15 shows a third embodiment of the device 1, in which the container 2 has a substantially tubular shape with a uniform cross-section along its longitudinal extension, with a closed bottom 2*c* and with the opposite end open so as to form the only passage opening 4. Moreover, there is a functional port 5 associated with a removable closure 6 and a monitoring port 7 that can be temporarily associated hermetically with the detection assembly 8 by virtue of connection means 12.

This embodiment of the device 1 is particularly designed to be used to package bulk products arranged inside the accommodation compartment 3 directly in contact with the internal walls of the container 2.

FIG. 16 shows a fourth embodiment of the device 1 that differs from the previous one only in that the detection assembly 8 is permanently associated hermetically with the monitoring port 7 by interposition of connection means 12.

Finally, FIG. 17 shows a fifth embodiment of the device 1 in which the container 2 has a substantially parallelepiped shape that is internally hollow, with a closed bottom 2*d* and the opposite end open so as to form the only passage opening 4. Moreover, there is a functional port 5 associated with a removable closure 6 and a monitoring port 7 permanently associated hermetically with a detection assembly 8. Alternatively, the detection assembly 8 may be temporarily associated hermetically with the monitoring port 7 by interposition of connection means 12.

This embodiment of the device 1 is particularly intended to be used to package products contained within one or more containment elements 13 arranged in the accommodation compartment 3 formed inside the container 2.

In use, in order to package a certain amount of products, loose or collected within a containment element 13, by using a device 1 having the corresponding detection assembly 8 provided at least with a sensor 10 for measuring the concentration of an inert gas of the type of carbon dioxide, the following operational steps are performed:

- if provided, sealing (by tying, heat-sealing or the like) the second opening 4*b;*
- introducing the products in the accommodation compartment 3 through the first opening 4*a* or the only passage opening 4;
- sealing (by tying, heat-sealing or the like) the first opening 4*a* or the only passage opening 4;
- extracting the air that is present inside the accommodation compartment 3 through the functional port 5;
- activating the detection assembly 8 associated hermetically with the monitoring port 7;
- introducing an inert gas, preferably carbon dioxide, in the accommodation compartment 3 through the functional port 5 until a concentration value, measured by the inert gas concentration measurement sensor 10 of the detection assembly 8, is reached which is at least equal to an inert gas concentration threshold value that is desired or set in the electronic unit.

Such inert gas concentration threshold value is preferably set in the electronic unit of said assembly, which by comparing the measured concentration value with the threshold value can therefore perform an automatic check and signal to the operator when to stop introducing inert gas.

Alternatively, the operator can directly check the measured concentration value, stopping the introduction of inert gas when the desired threshold value is reached.

During subsequent storage of the device 1, at least one chemical-physical parameter of the atmosphere present inside the accommodation compartment 3 can be kept monitored by measuring it by means of the detection assembly 8 and comparing it with a corresponding critical threshold value that is desired or set in the electronic unit of said assembly.

If the device 1 is provided with the element 14, there is also a step of introducing the container 2 in said element.

Air extraction occurs by using a conventional vacuum pump the intake of which is connected hermetically to the functional port 5, either directly or by means of appropriate fittings.

The inert gas is introduced by using a conventional gas injection system in which the delivery is connected hermetically to the functional port 5, either directly or by means of appropriate fittings.

If two functional ports 5 are provided, the air is aspirated through the one that is equipped with first valve means that allow the passage of fluid toward the outside of the accommodation compartment 3, and the inert gas is introduced through the one equipped with first valve means that allow the passage of fluid toward the inside of said compartment.

Activation of the detection assembly 8 can occur at any time prior to the introduction of the inert gas.

If the detection assembly 8 is removable, it is necessary, prior to activation, to remove the closure 15 (if provided) and apply said assembly to the monitoring port 7 by engaging the connection means 12.

It should be noted that during the introduction of the inert gas the detection assembly 8 allows measuring continuously or at set time intervals the relative concentration in the atmosphere inside the accommodation compartment 3, so as to introduce exactly the desired amount thereof according to the concentration threshold value that is desired or set in the electronic data collection and processing unit of the detection assembly 8.

During the storage of the device 1, by means of the detection assembly 8 it is possible to perform an automatic control, either continuously or at set time intervals, of at least one chemical-physical parameter of the atmosphere that is present inside the accommodation compartment 3. The electronic unit of detection assembly 8 can be set to send alarm messages if said parameter reaches set critical threshold values. For example, if the parameter monitored during storage is the concentration of the inert gas in the atmosphere that is present inside the accommodation compartment 3, if the detected value drops below a preset critical threshold the electronic unit of the detection assembly 8 can send a message alerting operators that it is necessary to perform a top-up of inert gas in order not to compromise the preservation status of the products. Even while any refilling is being carried out, the detection assembly 8 allows continuous measurement of the concentration of the inert gas in the atmosphere inside the accommodation compartment 3, so as to introduce exactly the necessary amount thereof according to the threshold value set in the electronic unit of the detection assembly 8.

If needed, the products can be taken out by opening the second opening 4*b* (if provided) or the only passage opening 4.

These operational steps are exemplified in FIGS. 2-6 with reference to the first embodiment of the device 1, but other versions of the device 1 also remain valid.

Moreover, in order to to package a certain amount of products, either in bulk or collected within containment elements 13, by using a device 1 in which the corresponding detection assembly 8 is provided at least with a sensor 10 for measuring the concentration of an inert gas, such as carbon dioxide, and a pressure sensor 10, the following operational steps are performed:

- if provided, sealing (by tying, heat-sealing or the like) the second opening 4*b;*
- introducing the products in the accommodation compartment 3 through the first opening 4*a* or the only passage opening 4;
- sealing (by tying, heat-sealing or the like) the second opening 4*a* or the only passage opening 4;
- activating the detection assembly 8 associated with the monitoring port 7;
- aspirating the air that is present inside the accommodation compartment 3 through the functional port 5 until a pressure value inside said accommodation compartment, measured by the pressure sensor of the detection assembly 8, at least equal to a pressure threshold value that is desired or set in the electronic unit of said assembly is reached;
- introducing the inert gas, preferably carbon dioxide, in the accommodation compartment 3 through the functional port 5 until a concentration value, measured by the inert gas concentration measurement sensor 10 of the detection assembly 8, at least equal to an inert gas concentration threshold value that is desired or set in the electronic unit of said assembly is reached.

During the subsequent storage of the device 1, at least one chemical-physical parameter of the atmosphere that is present inside the accommodation compartment 3 can be kept monitored by measuring it by means of the detection assembly 8 during the storage of the device 1 and by comparing it with a corresponding critical threshold value that is desired or set in the electronic unit of said assembly.

If the device 1 is provided with the element 14, there is also a step of introducing the container 2 in such element.

If two functional ports 5 are provided, air is extracted through the one that is equipped with first valve means that allow the passage of fluid toward the outside of the accommodation compartment 3 and the inert gas is introduced through the one equipped with first valve means that allow the passage of fluid toward the inside of said compartment.

In this case, any application to the monitoring port 7 and the activation of the detection assembly 8 must be performed, at the latest, before air extraction.

This mode of operation makes it possible to perform automatically an optimal control of both the degree of vacuum applied to the container 2 and the concentration of inert gas present in the atmosphere inside the accommodation compartment 3 during packaging and subsequent storage.

During storage, the detection assembly 8 allows the pressure value and/or the concentration of the inert gas inside the accommodation compartment 3 to be kept monitored continuously or at set intervals, so that alarm messages are sent if desired or set critical threshold values are reached.

Likewise, other chemical-physical parameters of the atmosphere inside the accommodation compartment 3, such as temperature, humidity and/or oxygen concentration, can be monitored during storage, depending on the sensors with which the detection assembly 8 is equipped.

In practice it has been found that the described invention achieves the intended aim and objects and in particular the fact is stressed that the device according to the invention, as well as the packaging method that uses said device, makes it possible to ensure an optimal state of preservation of the products automatically, minimizing the use of labor.

Moreover, the device according to the invention has a structure that is simple, easy to provide and low-cost, furthermore allowing reuse of the electronic components in the version with removable detection assembly.

The invention thus conceived is susceptible of numerous modifications and variations, all of which are within the scope of the appended claims.

All the details may furthermore be replaced with other technically equivalent elements.

In practice, the materials used, as well as the contingent shapes and dimensions, may be any according to the requirements without thereby abandoning the protective scope of the claims that follow.

The disclosures in Italian Patent Application No. 102022000010997 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A method for packaging products, comprising the following steps:

providing a device comprising:

a container made of a material that is flexible and substantially impermeable to gases and water vapor, which forms inside the container an accommodation compartment for accommodating products and is provided with at least one passage opening for the introduction and/or evacuation of products into/from said accommodation compartment, at least one functional port which is configured to be closed hermetically and is associated with said container in fluid communication with said accommodation compartment, at least one monitoring port associated with said container in fluid communication with said accommodation compartment, which is configured to allow a passage of fluid at least from an inside of said accommodation compartment toward the outside, and a detection assembly for detecting at least one chemical or physical parameter of the atmosphere within said accommodation compartment, wherein said detection assembly comprises a measurement chamber which is associated in fluid communication with said accommodation compartment through said monitoring port and at least one sensor for measuring said at least one parameter associated with said measurement chamber, and wherein said detection assembly is provided with said at least one sensor for the measurement of the concentration of an inert gas, providing a quantity of products to be packaged, introducing said quantity of products in said accommodation compartment through said at least one passage opening, sealing said at least one passage opening, aspirating air that is present within said accommodation compartment through said at least one functional port, activating said detection assembly associated with said monitoring port, introducing said inert gas in said accommodation compartment through said at least one functional port until an inert gas concentration value, measured by the inert gas concentration measurement sensor of said detection assembly, is reached which is at least equal to an inert gas concentration threshold value that is desired or set in the electronic unit of said assembly.

2. The method according to claim 1, further comprising the step of keeping monitored, during storage, at least one chemical or physical parameter of the atmosphere that is present within said accommodation compartment, measuring it by means of said detection assembly and comparing it with a corresponding critical threshold value that is desired or set in the electronic unit of said assembly.

3. A method for packaging products, comprising the following steps:

providing a device comprising:

a container made of a material that is flexible and substantially impermeable to gases and water vapor, which forms inside the container an accommodation compartment for accommodating products and is provided with at least one passage opening for the introduction and/or evacuation of products into/from said accommodation compartment, at least one functional port which is configured to be closed hermetically and is associated with said container in fluid communication with said accommodation compartment, at least one monitoring port associated with said container in fluid communication with said accommodation compartment, which is configured to allow a passage of fluid at least from an inside of said accommodation compartment toward the outside, and a detection assembly for detecting at least one chemical or physical parameter of the atmosphere within said accommodation compartment, wherein said detection assembly comprises a measurement chamber which is associated in fluid communication with said accommodation compartment through said monitoring port and at least one sensor for measuring said at least one parameter associated with said measurement chamber, and wherein said detection assembly is provided at least with a sensor for measuring the concentration of an inert gas and with a pressure sensor;

providing a quantity of products to be packaged, introducing said quantity of products in said accommodation compartment through said at least one passage opening, sealing said at least one passage opening, activating said detection assembly associated with said monitoring port, aspirating air that is present inside said accommodation compartment through said at least one functional port until a value of the pressure inside said accommodation compartment, detected by the pressure sensor of said detection assembly, is reached which is at least equal to a pressure threshold value that is desired or set in the electronic collection and processing unit of said assembly, introducing said inert gas in said accommodation compartment through said at least one functional port until an inert gas concentration value, measured by the inert gas concentration measurement sensor of said detection assembly, is reached which is at least equal to an inert gas concentration threshold value that is desired or set in the electronic collection and processing unit of said assembly.

4. The method according to claim 3, further comprising the step of keeping monitored during storage at least one chemical or physical parameter of the atmosphere that is present within said accommodation compartment, measuring it by means of said detection assembly and comparing it with a corresponding critical threshold value that is desired or set in the electronic collection and processing unit of said assembly.

* * * * *